US005224322A

United States Patent [19]

van den Toorn

[11] Patent Number: 5,224,322

[45] Date of Patent: Jul. 6, 1993

[54] WALL CONSTRUCTION, WITH WALL COMPONENTS FIXED BY MEANS OF BLIND COUPLINGS TO FRAMEWORK COMPONENTS

[75] Inventor: Frans R. van den Toorn, Almere, Netherlands

[73] Assignee: Maars Holding B.V., Harderwijk, Netherlands

[21] Appl. No.: 795,806

[22] Filed: Nov. 21, 1991

[30] Foreign Application Priority Data

Nov. 22, 1990 [NL] Netherlands ..... 9002550

[51] Int. Cl.[5] ..... E04B 2/00

[52] U.S. Cl. ..... 52/765; 52/241; 52/715; 52/127.5; 52/126.6; 52/481; 403/331

[58] Field of Search ..... 52/765, 489, 481, 238.1, 52/241, 235, 715, 127.5, 127.6, 127.7, 127.8, 127.9; 403/331, 386

[56] References Cited

U.S. PATENT DOCUMENTS

| | | | |
|---|---|---|---|
| 2,123,458 | 7/1938 | Woehler et al. . | |
| 4,000,596 | 1/1977 | Magill et al. | 52/481 |
| 4,018.020 | 4/1977 | Sauer et al. | 52/481 |
| 4,094,114 | 6/1978 | Burcham . | |
| 4,263,764 | 4/1981 | Wendt | 52/481 |
| 4,397,127 | 12/1983 | Mieyal | 52/241 |
| 4,621.473 | 11/1986 | Wendt | 52/481 |
| 4,870,794 | 10/1989 | Menchetti | 52/481 |
| 5,040,345 | 8/1991 | Gilmour | 52/241 |
| 5,060,434 | 10/1991 | Allison | 52/481 |
| 5,152,117 | 10/1992 | Wynar | 52/241 |

FOREIGN PATENT DOCUMENTS

| | | |
|---|---|---|
| 927567 | 6/1973 | Canada . |
| 1025758 | 4/1966 | United Kingdom . |
| 1161116 | 8/1969 | United Kingdom . |

*Primary Examiner*—Carl D. Friedman
*Assistant Examiner*—Wynn E. Wood
*Attorney, Agent, or Firm*—Edmund M. Jaskiewicz

[57] ABSTRACT

Wall construction, comprising a number of framework components, including uprights and horizontal beams, at a distance from each other, a number of wall components, including panels and casings, and coupling means composed of a number of couplings each designed for coupling a wall component to a framework component, a wall component coupled to a framework component having an essentially vertically running straight edge along which one or more couplings are fitted. A coupling comprises a guide means for the framework component, a sliding plate which is slidable vertically over or in the guide means, and a hook element fitted on a wall component with a lip extending essentially vertically, in such a way that after placing of the wall component against the framework component the sliding plate is slid by means of a pushing end of a tool from an uncoupled position in a vertical direction along the adjacent edge of the wall component to a coupled position over the lip.

10 Claims, 9 Drawing Sheets

WALL CONSTRUCTION, WITH WALL COMPONENTS FIXED BY MEANS OF BLIND COUPLINGS TO FRAMEWORK COMPONENTS

BACKGROUND OF THE INVENTION

The invention relates to a wall construction, comprising a number of framework components, including uprights and horizontal beams, at a distance from each other, a number of wall components, including panels and casings, and coupling means composed of a number of couplings each designed for coupling a wall component to a framework component, a wall component coupled to a framework component having an essentially vertically running straight edge along which one or more couplings are fitted.

In the known wall construction the fixing means comprise Omega sections, of which the outside of the top is placed between two adjacent wall components against a wall framework component, the ends of the legs of the section holding edge parts of the wall components against the framework component, and the section being fixed to the framework component by means of fixing screws from the inside of the section. After fixing of the Omega section to the framework component, an elongated cover element is pressed into the section and over the ends of the legs of the section. Since the inside of the Omega section must be accessible for a tool, for example a screwdriver, the Omega section, and therefore the cover element, is relatively broad, which by current standards gives an unattractive appearance. The object of the invention is to eliminate the disadvantages of the known wall construction.

SUMMARY OF THE INVENTION

This object is achieved for the wall construction of the type mentioned in the preamble in that a coupling comprises a guide means for the framework component, a sliding plate which is slidable vertically over or in the guide means, and a hook element fitted to a wall component, with an essentially vertically extending lip, in such a way that after placing of the wall component against the framework component the sliding plate can be slid by means of a pushing end of a tool from an uncoupled position in a vertical direction along the edge of the wall component extending alongside to a coupled position over the lip. The building of a wall construction is greatly simplified in this way, can be achieved more quickly, and is consequently relatively cheap. When the sliding plate is slid by means of the tool over the lips of two hook elements of two adjacent wall components, the wall components can then be slid against each other in the horizontal direction. Since no further operation is necessary, a further time gain, and cost saving, is obtained, while an attractive appearance is still obtained.

BRIEF DESCRIPTION OF THE DRAWINGS

Further features and advantages of the invention will emerge from the explanation which follows with reference to the appended drawings, in which:

FIG. 3 shows a part of an upright, a sliding plate according to FIG. 1, and two hook elements according to FIG. 2 of two adjacent wall components which are uncoupled, leaving out the wall components;

DETAILED DESCRIPTION OF THE DRAWINGS

Figure 1:
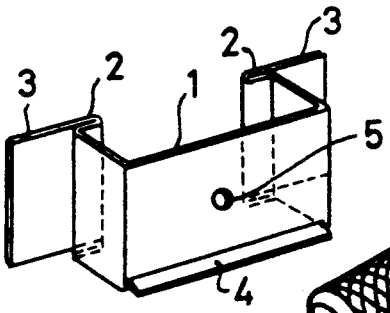
FIG. 1 shows a first embodiment of a sliding plate of a coupling of a wall construction according to the invention.

FIG. 1 shows in perspective a sliding plate 1 for a coupling of a wall construction according to the invention. The sliding plate 1 has a cross-section which is essentially a U-shape with ends 2 bent towards each other. The sliding plate 1 also has projections or wings 3 going out from the legs. One edge of the base of the U-shape has a locating edge 4 diverging outwards from the sliding plate 1. The base of the U-shape has a passage 5 in the centre. As can be seen in the figure, the sliding plate 1 can be formed from a single strip of material.

Figure 2:
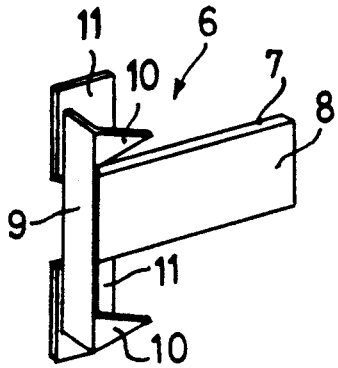
FIG. 2 shows a first embodiment of a hook element of a coupling of a wall construction according to the invention.

FIG. 2 shows in perspective a hook element 6 which is designed to be fixed to a wall component (not shown), in particular a gypsum- cartonboard (gypsum with cartonboard covering) panel, or a board of a similar material structure. The hook element 6 comprises a base part 7, one side 8 of which is intended for fitting against a rear side of the wall component. The hook element 6 also has a part 9 which runs along a vertical edge of the wall component after the wall construction is completed, and teeth 10 which run parallel to the base part 7 and are inserted into the edge part of the wall component. The hook element 6 also has lips 11 which in FIG. 2 are displaced backwards relative to the base part 7 over a distance which is essentially equal to the thickness of the base of the sliding plate 1 of FIG. 1. Because the hook element 6 of FIG. 2 has two lips 11, an upper and a lower lip, it is possible to select a coupling in which a sliding plate 1 is slid from the top over the upper lip 11 or from the bottom over the lower lip 11. For fixing to a panel with a material structure such as that of a gypsum- cartonboard panel, the hook element 6 does not require fixing to the panel with other means such as screws or adhesive. The base part 7 is preferably relatively long, as shown in FIG. 2, in order to make it easier to hold the hook element 6 during its fixing to the panel, and in order to prevent accidental turning of the hook element 6 after fixing, in the clockwise direction viewed from the top in FIG. 2.

FIG. 3 shows a part of an upright 12. The sliding plate 1 can be slid at one end of the upright 12 over edges of the upright 12. The material of the sliding plate is, however, preferably so resilient that it can be bent at any point of the upright 12 around edges thereof. The sliding plate 1 can in this case advantageously be held by the wings 3 and then bent. The dimensions of the sliding plate 1 are preferably such that the sliding plate 1 does not slide by itself vertically over the upright, but remains in position through friction. The locating edge 4 helps when the sliding plate 1 is being slid over the lips 11.

Figure 4:
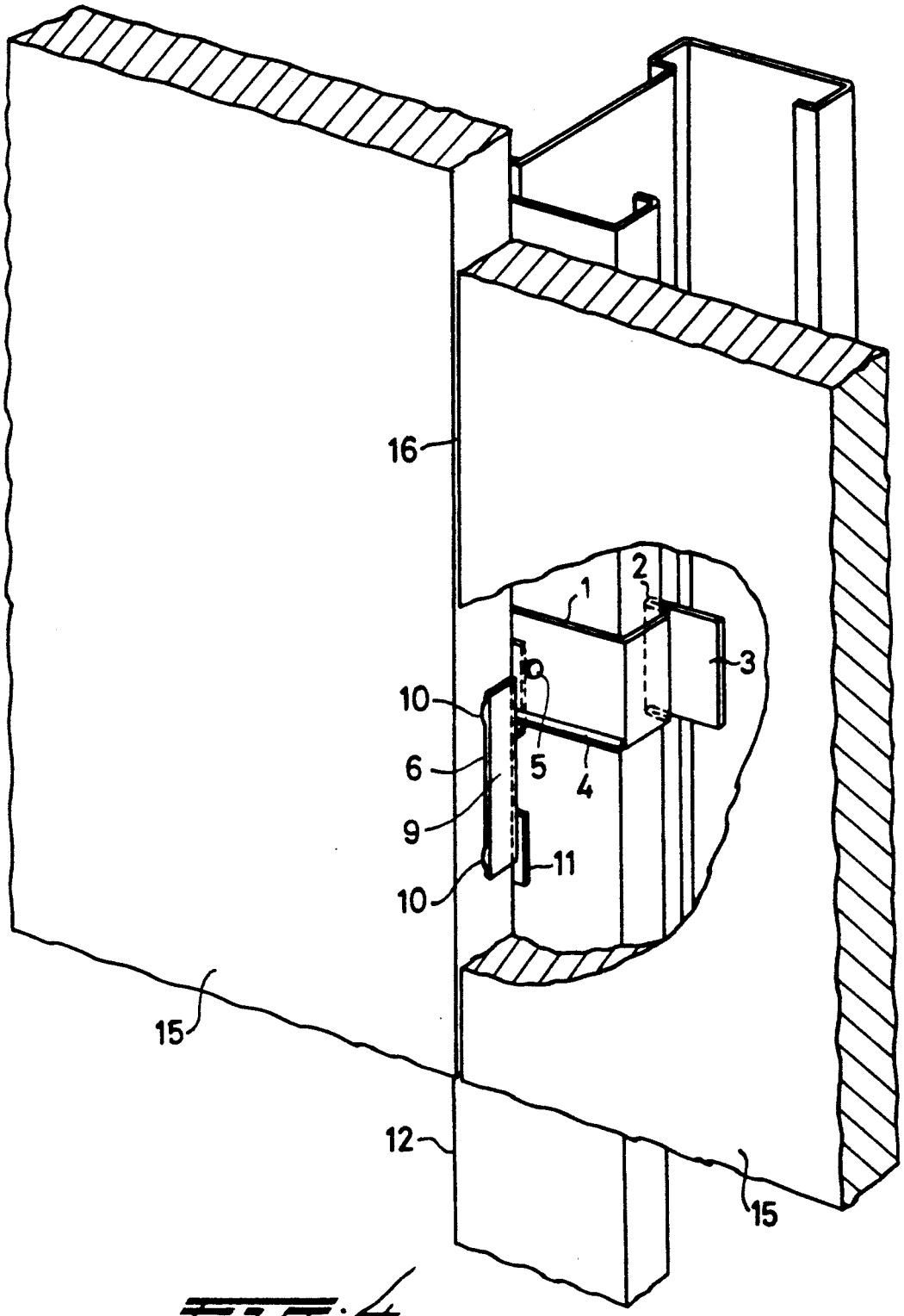
FIG. 4 shows the construction of FIG. 3, coupled to the wall components.

FIG. 3 also shows two hook elements 6. Each of these two hook elements 6 is fixed to one wall component, in particular a panel, of two wall components which are not shown in FIG. 3. After the wall components are placed with the hook elements 6 against the upright 12, a tool 13, preferably having a flat end 13', is used to push the sliding plate 1 so far downwards in the direction of the arrows 14 that the sliding plate 1 in the end extends over the upper lips 11. The tool 13 can then be removed, and the wall components can be pushed against each other in the horizontal direction. The vertical parts 9 of the hook elements 6 will subsequently be situated against each other. This means that no gap, or only a very narrow gap 16, will remain between the wall components. This is shown in FIG. 4, in which two panels 15 are coupled to the upright 12 by means of a sliding plate 1 and the hook elements 6 shown in FIG. 3. The sliding plate 1 could also be slid from the bottom over the lower lips 11, in which case the sliding plate 1 prior to the coupling is situated below the hook elements 6 with the locating edge 4 on the top side thereof.

The passage 5 of the sliding plate 1 is designed to allow through a screw for screwing the sliding plate 1 to an upright. The wings 3 can then be used in a known manner for suspending wall components therefrom.

Figure 5:
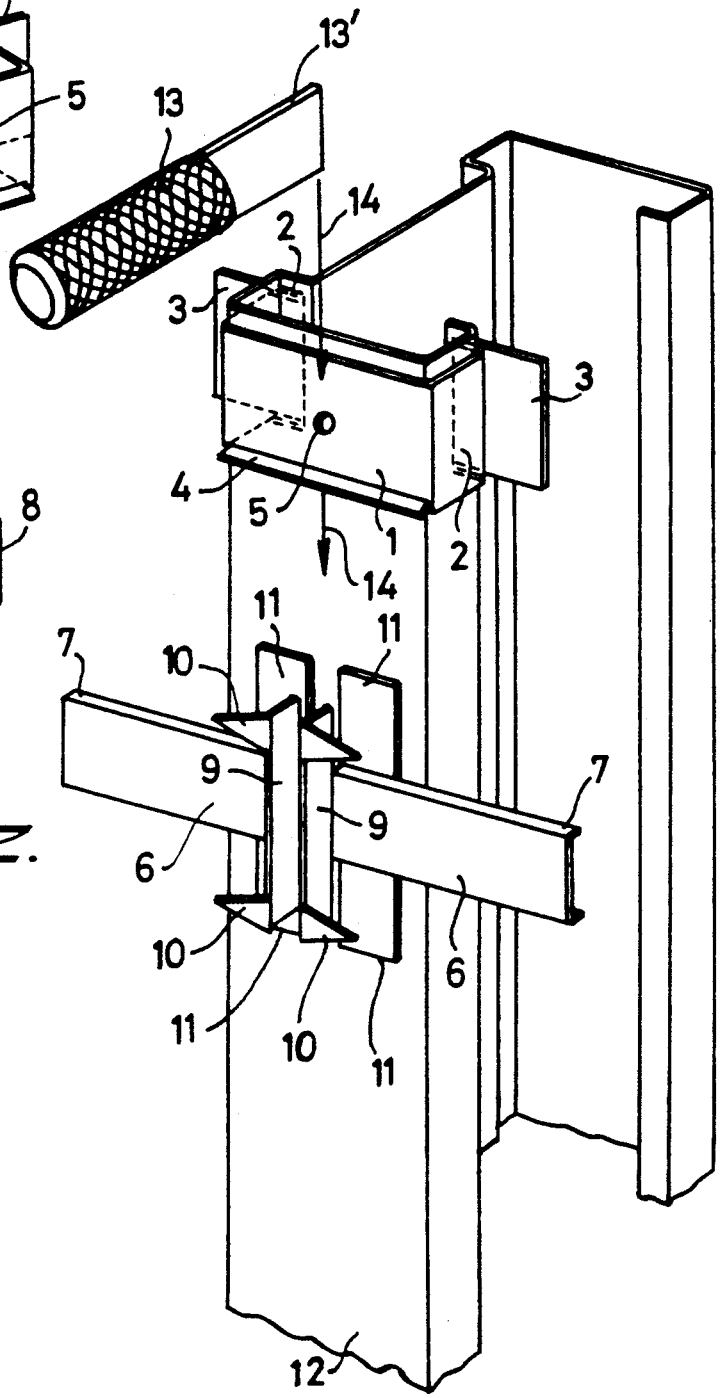
FIG. 5 shows a guide means of another embodiment of a wall construction according to the invention.

In the case of the wall construction according to FIGS. 3 and 4 edges of the upright 12 form guide means for guiding the sliding plate 1 essentially vertically. It can, however, happen in practice that the upright 12 is not accessible or is not suitable for fitting thereon a sliding plate of the type shown in FIG. 1 and for sliding such a sliding plate. This is, for example, the case when a wall construction with panels placed over and against one another needs to be assembled. In order then still to be able to apply the essence of the invention, use is made of a guide element 17 such as that shown in FIG. 5. The guide element 17 has a cross-section which is essentially U-shaped with ends bent away from each other, forming parallel guide edges 18. The base of the guide element 17 has at least one passage, but preferably at least two passages 19 for passing through a screw. The height of the legs of the guide element 17 is approximately equal to the thickness of the material of a sliding plate 20 of a type such as that shown in FIG. 6. The sliding plate 20 has a cross-section which is essentially U-shaped with ends bent towards each other, forming parallel guide edges 21 which can engage around the guide edges 18 of the guide element 17.

Figures 5, 6, 7:
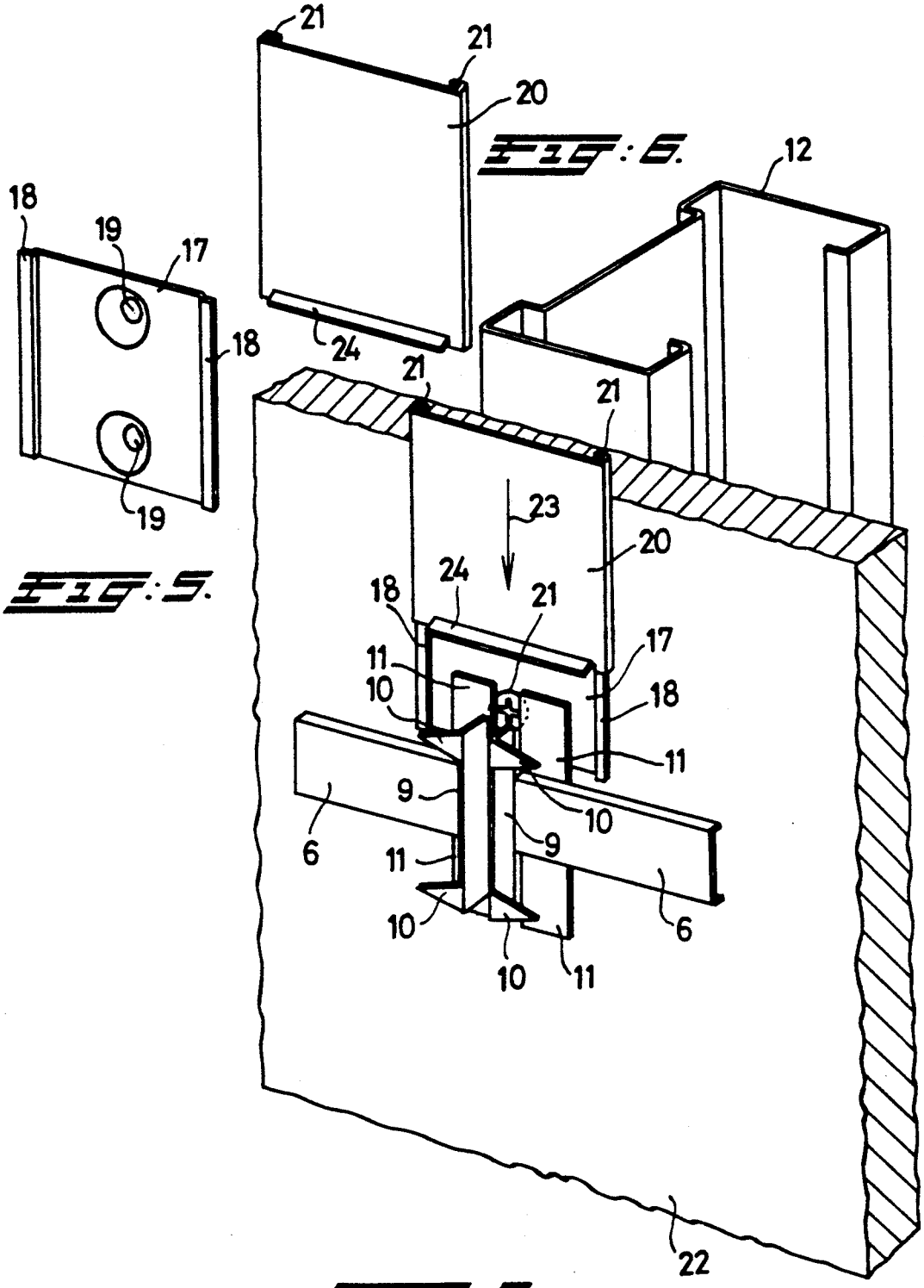
FIG. 6 shows a sliding plate for use with the guide means of FIG. 5.
FIG. 7 shows a part of an upright, a guide means according to FIG. 5, a sliding plate according to FIG. 6, and two hook elements according to FIG. 2 of two adjacent wall components which are uncoupled, leaving out the wall components.

As shown in FIG. 7, the guide element 17 is fixed by means of at least one screw 21 to a panel 22, called inner panel hereinafter. The screw 21 is also used for fixing the inner panel 22 to the upright 12. After fixing of the guide element 17 to the inner panel 22, the guide edges 18 of the guide element 17 run vertically. The sliding plate 20 is slid over the guide edges 18 The dimensions of the guide element 17 and of the sliding plate 20 are such that the sliding plate 20 does not slide by itself over the guide element 17.

FIG. 7 also shows, in the same way as in FIG. 3, two hook elements 6 which are fixed to wall components, in particular outer panels, such as the panels 15, which for the sake of clarity are not shown in FIG. 7.

After the outer wall components or panels 15 are placed against the inner panel 22, the tool 13 with the preferably flat end 13' can be used in the same way as in the construction of FIG. 3 for moving the sliding plate 20 downwards so far in the direction of the arrow 23 that first a locating edge 24 of the sliding plate 20 and then a greater part of the sliding plate 20 engages over the upper lips 11 of the hook elements 6. The outer wall components or panels can then be pushed in the horizontal direction against each other, with the result that a gap between the wall components, and thus between the parts 9 of the hook elements 6 is minimised.

Figure 8:
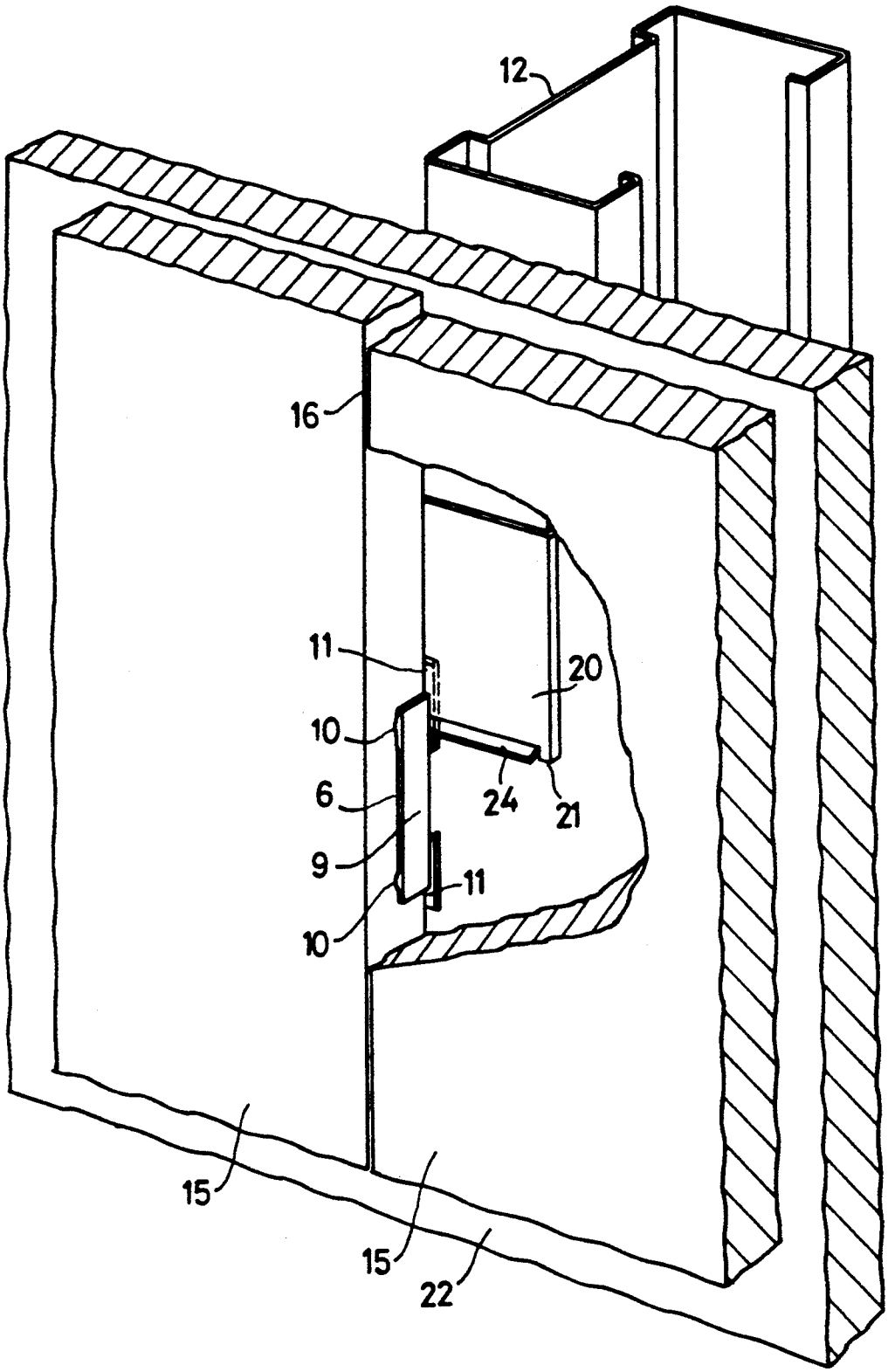
FIG. 8 shows the construction of FIG. 7, coupled to the wall components.

FIG. 8 shows the coupled state of the wall construction according to FIG. 7, in which the outer panels 15 are also shown. The guide element 17 cannot be seen in FIG. 8 because it is completely covered by the sliding plate 20. In this embodiment too the gap 16 between the panels 15 is minimal.

Figure 9:
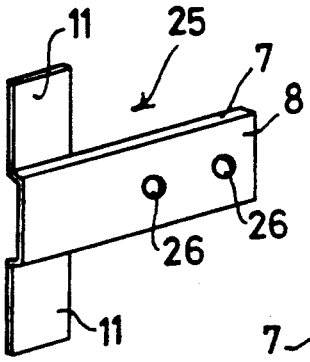
FIG. 9 shows another embodiment of a hook element.

FIG. 9 shows in perspective another embodiment of a hook element 25, which differs from the hook element shown in FIG. 2 in that, instead of the edge part 9 with the teeth 10, it has holes 26 in the base part 7. The holes 26 are suitable for the passage of screws (not shown) with which the hook element 25 can be screwed to a wall component, in particular a panel, and more particularly a chipboard panel.

Figure 10:
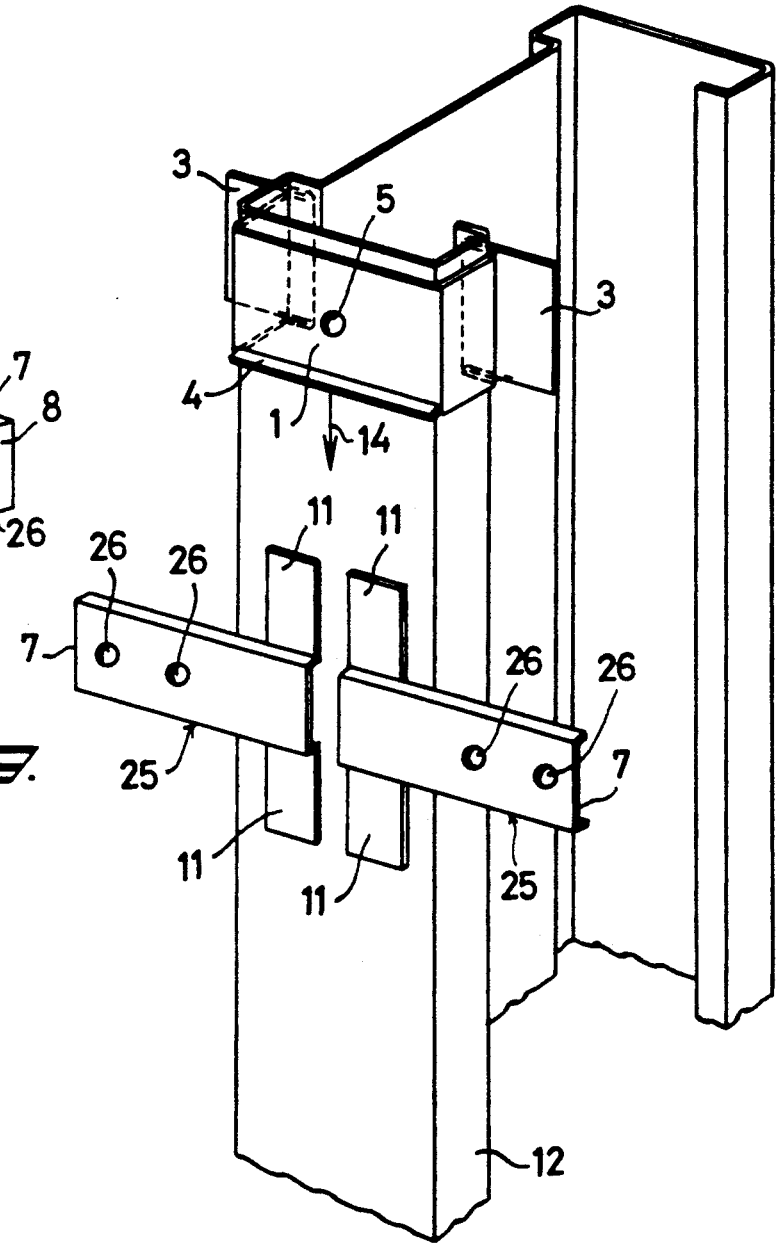
FIG. 10 shows a part of an upright, a sliding plate according to FIG. 1, and two hook elements according to FIG. 9 of two adjacent wall components which are uncoupled, leaving out the wall components.

FIG. 10 shows a similar configuration to that of FIG. 3, in which the hook elements 6 are replaced by the hook elements 25.

Figure 11:
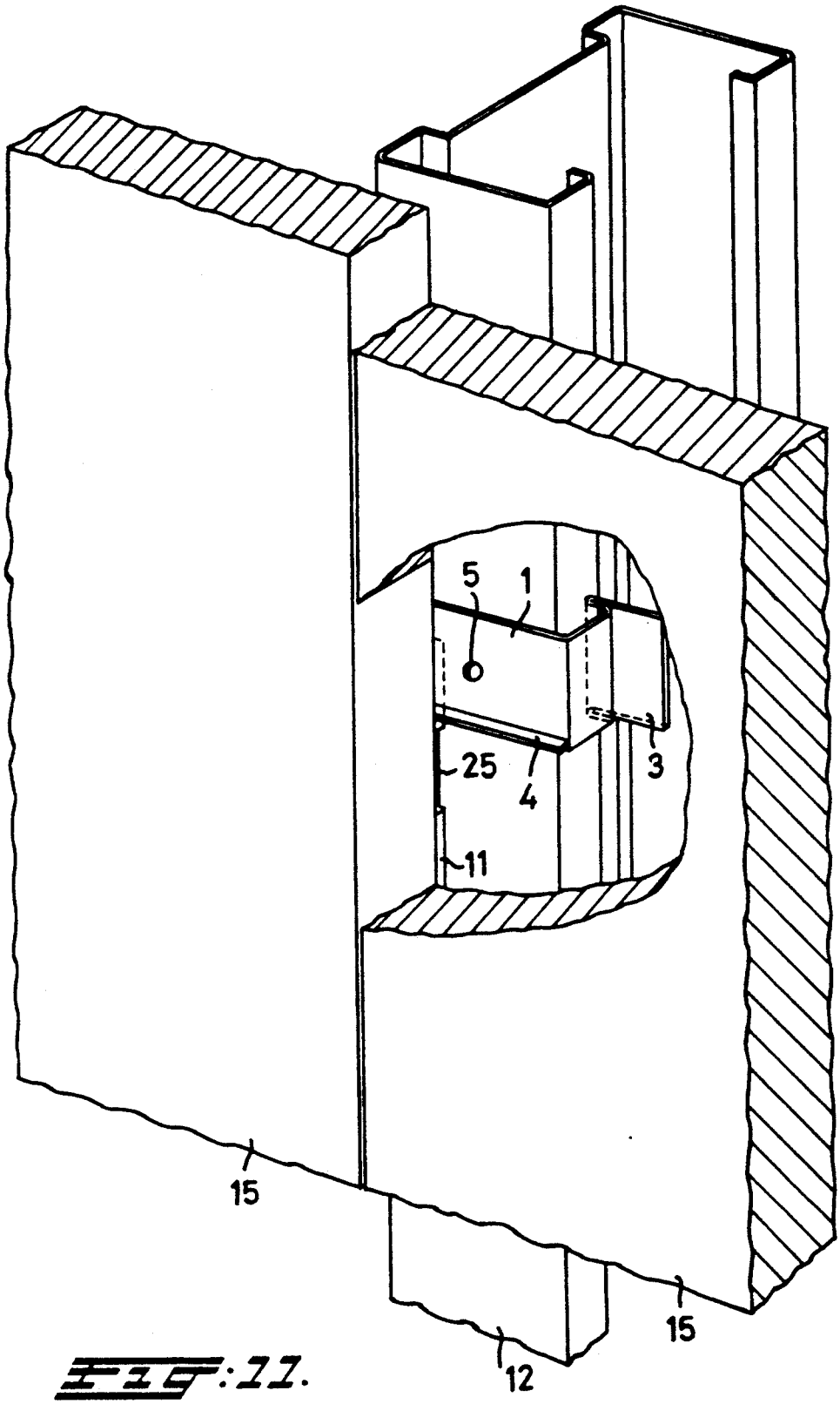
FIG. 11 shows the construction of FIG. 10, coupled to the wall components.

FIG. 11 shows a similar configuration to that of FIG. 4, in which the one hook element 6 shown is replaced by a hook element 25.

Figure 12:
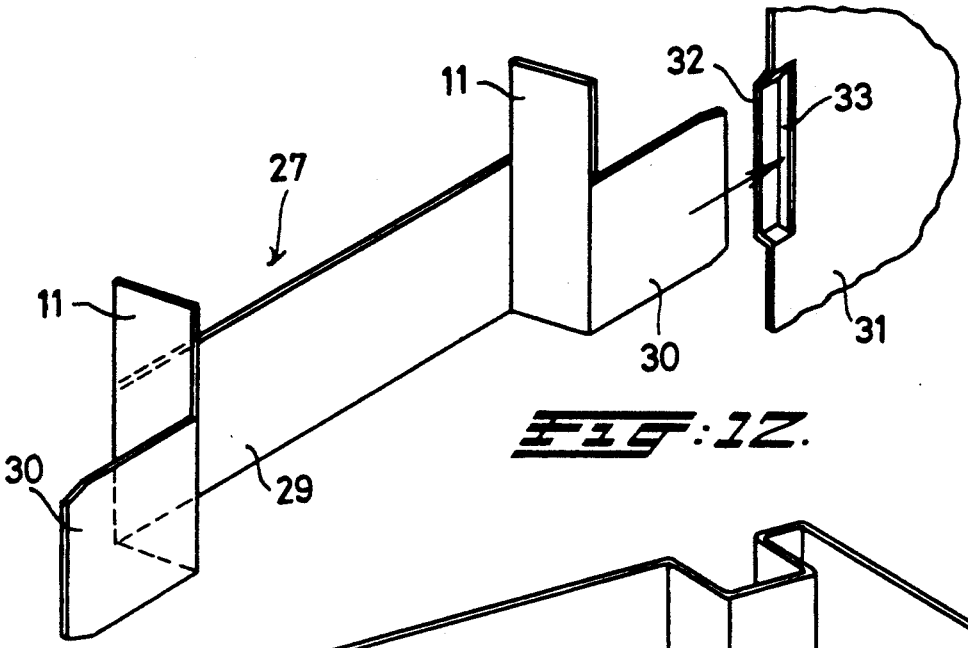
FIG. 12 shows a third embodiment of a hook element for a coupling of a wall construction according to the invention and a part of a wall component.
Figure 13:
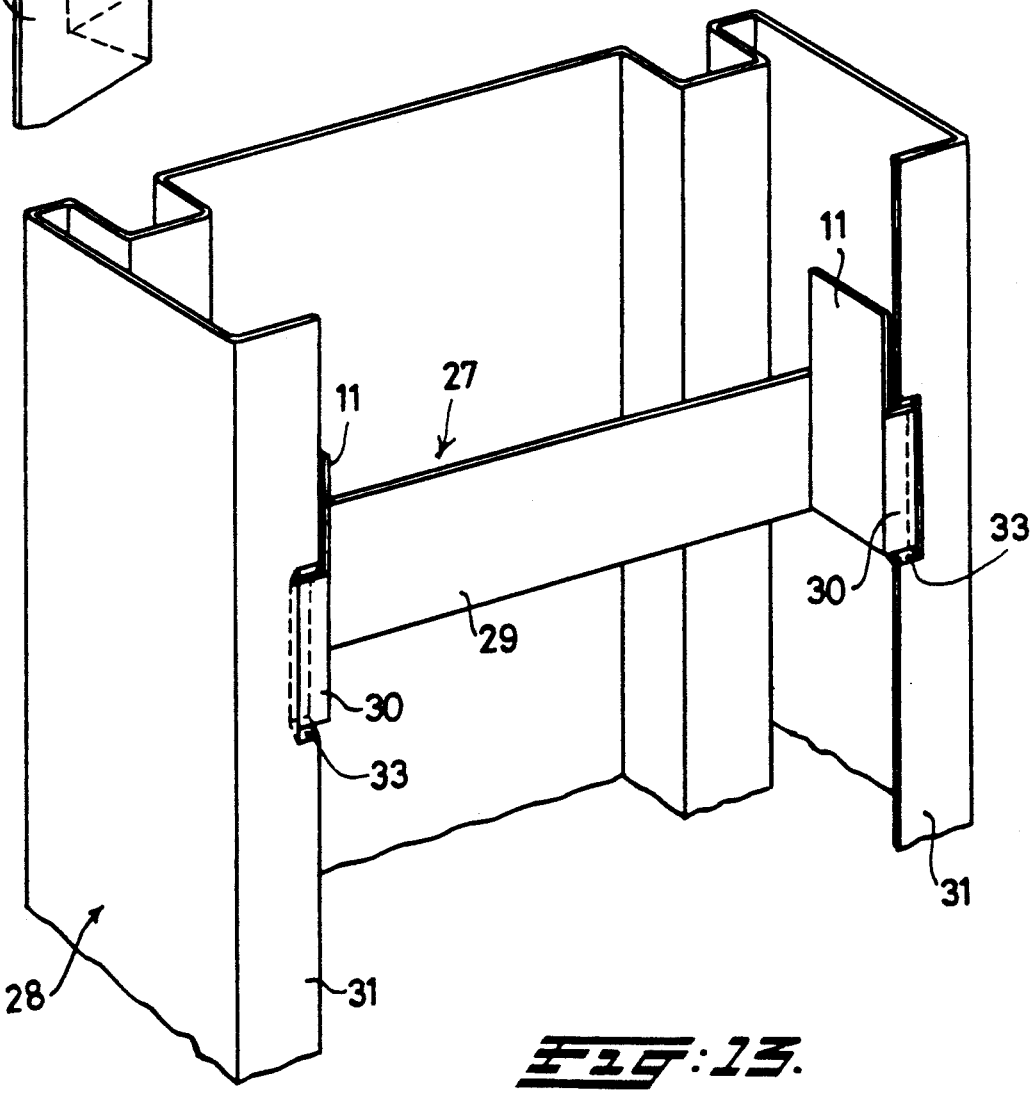
FIG. 13 shows a larger part of the wall component of FIG. 12, and a hook element according to FIG. 12 inserted into it.

FIG. 12 shows in perspective a different embodiment of a hook element 27. The hook element 27 is intended for coupling to a casing component 28, as shown in FIG. 13. The hook element 27 has a cross-section which is essentially U-shaped with ends bent away from each other. After coupling of the hook element 27 to the casing component 28, the bridge part or the base 29 of the hook element 27 is intended to run crosswise to the wall to be constructed. The same type of lips 11 as those in the other hook elements 6 and 25 extend at right angles to the legs. Although only the upper lips 11 are shown, the hook element 27 can also have lower lips 11. The ends of the hook element 27 form other lips 30 running parallel to the base 29.

The casing component 28 has in facing edge parts 31 smaller, horizontally displaced edge parts 32, as a result of which a vertically extending slit 33 is formed between each pair of edge parts 31, 32. The slit 33 is suitable for receiving therein one of the other lips 30 of the hook element 27. In order to be able to place the hook element 27 in the casing component 28 in the manner shown in FIG. 13, the hook element 27 is preferably made of resilient material, so that the hook element 27 can be bent and the other lips 30 thereof can be inserted into slits 33 lying opposite each other.

Figure 14:
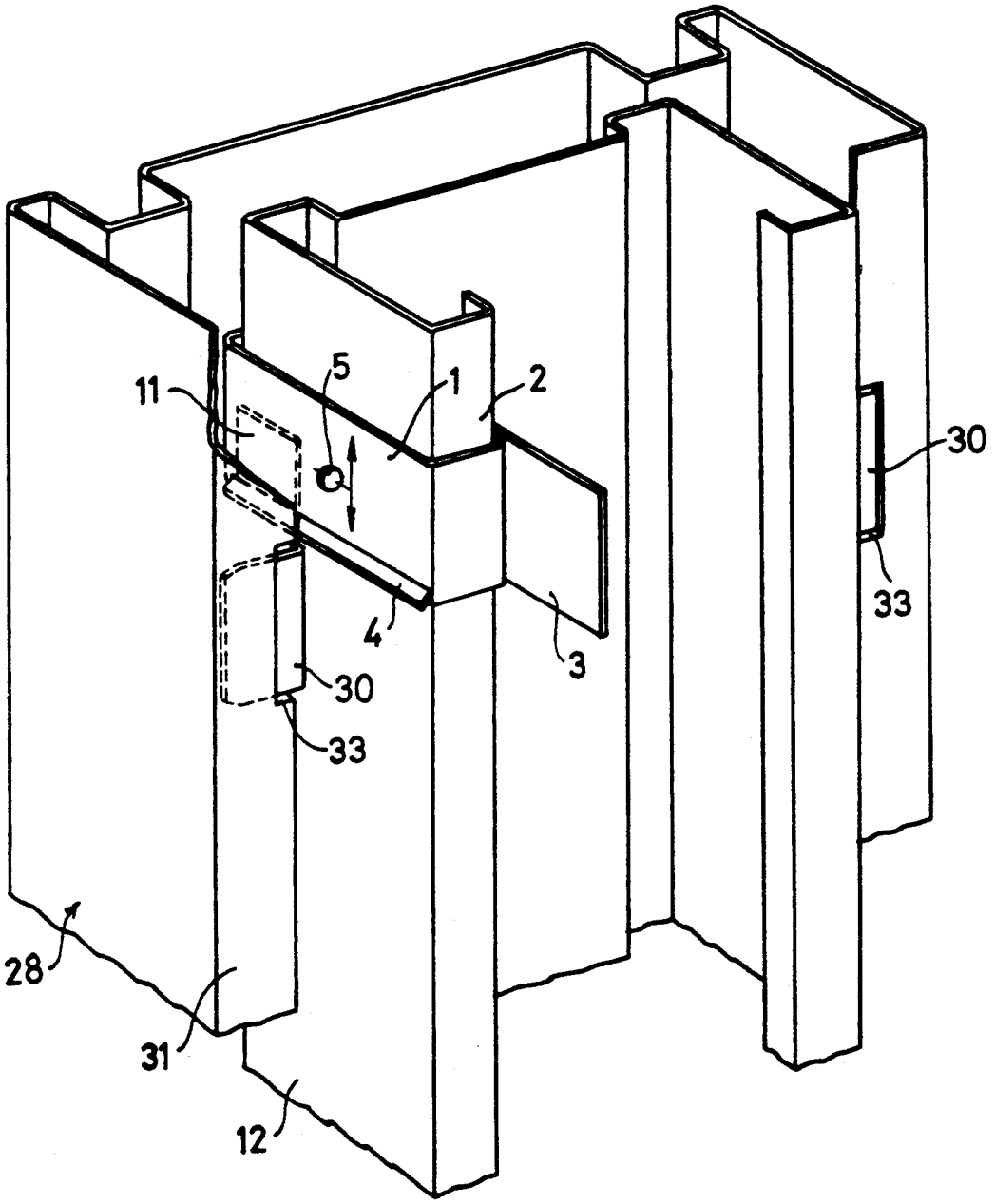
FIG. 14 shows the wall component and the hook element according to FIG. 13 coupled to an upright with a sliding plate according to FIG. 1.

After the hook element 27 has been placed in a casing component 28, the lips 11 of the hook element 27 can be used in the same way as the lips 11 of the other hook elements 6 and 25. FIG. 14 shows in perspective the way in which a casing component 28 can be coupled to an upright 12 by using a hook element 27 and a sliding plate 1. Just like the constructions shown in the other figures, the sliding plate 1 can be moved vertically by using the tool 13 with the preferably flat end 13' between the casing component 28 and a wall component placed next to it (not shown).

Figure 15:
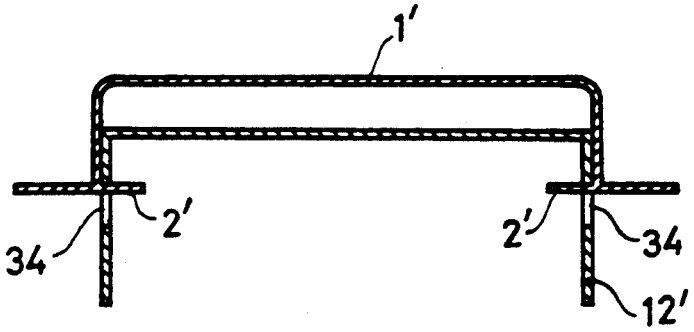
FIG. 15 shows a cross-section, in top view, of a sliding plate according to FIG. 1, which is inserted into an upright.
Figure 16:
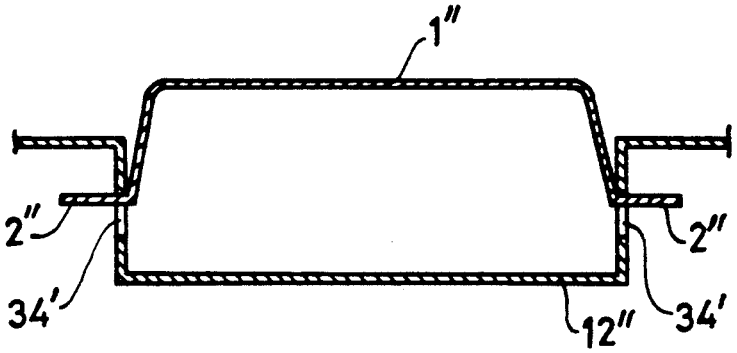
FIG. 16 shows a cross-section, in top view, of another embodiment of a sliding plate for a coupling of a wall construction according to the invention which is inserted into an upright.

In the constructions of the figures explained above guide edges 2, 21 always engage around edge parts of guide means, in particular edge parts of, for example, an upright 12, or around edge parts 18 of a guide element 17. FIGS. 15 and 16 show top views of cross-sections of uprights 12' and 12'' respectively with vertically running slits 34, 34' which are suitable for receiving therein ends 2', 2'' of sliding plates 1', 1'' respectively. The edge parts of the constructions shown in FIGS. 15 and 16 thus engage in, instead of around, edge parts of a framework part of the wall construction, as in the case of the other figures. In order to permit easy movement of the sliding plates 1', 1'' in the slits 34, 34', the material of the sliding plates 1', 1'' is preferably resilient, as a result of which it can be bent and the ends 2', 2'' inserted into the slits 34, 34, respectively Opposite the panel along which the end 13' of the tool 13 is slid, a framework component such as the upright 12 can have a recess which is suitable for receiving therein and guiding the end of the tool 12. Sliding of the sliding plate 1, 20, 1', 1'' is facilitated in this way.

It is pointed out that the invention also applies to constructions in which a sliding plate can be slid over edges of a section of a horizontal beam or over edges of a guide element fixed to a horizontal beam, such as the guide element 17.

What is claimed is:

1. Coupling assembly for coupling a wall component (15, 31) and a frame component (12, 22) of a wall construction, comprising a first engaging means (6, 25, 27) which is to be attached to the wall component along a substantial vertical edge of the wall component and between the wall component and the frame component, a guide means (12, 20, 34, 34') provided by the frame component, and a slide member (1, 1', 1'', 20), which, after being engaged to the frame component, can slide through said guide means along said edge of the wall component and which provides a second engaging means, such that by moving a tool (13) along said edge and against the slide member the slide member can be moved from a first position in which the first and second engaging means are uncoupled to (14, 23) a second position in which the first and second engaging means are coupled, the first engaging means is a hook member having a lip (11) extending vertically and substantially as a whole at a minor distance from the wall component, the slide member is a piece of U-shaped profile, of which the base is substantially flat and is destined to be slidable between the wall component and the frame component, and parts (2, 2', 2'', 21) of the legs of said U-profile of the slide member being bent for engagement with said guide means, and the base of the U-profile of the slide member having a run-on edge part (4, 24) at the side of said base faced to the second position and suitable to catch the lip and guide it to between said base and the frame component when the slide member is moved to the second position.

2. Coupling assembly according to claim 1, wherein the base of the U-profile of the slide member is resiliently bendable along an axis extending in parallel to the direction of sliding.

3. Coupling assembly according to claim 1 or 2, wherein the guide means is a guide member (17) fixed to the frame.

4. Coupling assembly according to claim 3, wherein the guide member (17) is fixed to an other wall component (22), which is fixed previously to the frame and which can be considered as a frame component for the assembly.

5. Coupling assembly according to claim 1, wherein the slide member has at each of the ends of its U-profile a handling wing (3) extending substantially in parallel to the base of the U-profile.

6. Coupling assembly according to claim 1, wherein the width of the base of the U-profile of the slide member is substantially greater than the total width of two lips (11) of hook members attached to adjacent wall components catched behind said base and the frame component.

7. Coupling assembly according to claim 1, wherein the edge of the wall component (28) to be coupled is provided by an edge part (31) of the wall component extending essentially at right angles to a main face of the wall, near the lip of the hook member the edge part of the wall component is displaced partially (32) in a direction parallel to said main face behind the wall component (28) such as to provide a slit-shaped passage (33) extending in parallel to said edge, and in that the hook member has a further lip (30) which is suitable to be inserted into the passage and which is to be held in the passage after insertion.

8. Coupling assembly according to claim 7, wherein the hook member (27) has a cross-section which is essentially U-shaped with outwardly bent ends, each of which provide a said further lip (30) and each being intended to be inserted in a said-slit-shaped passages of two opposite slit-shaped passages (33) of one or two wall components.

9. Coupling assembly according to claim 8, wherein the hook member (27) is so resilient that, while bending it along an axis extending in parallel to said edge, said further lips (30) can be inserted into said opposite slit-shaped passages (33).

10. Coupling assembly according to claim 1, wherein between positions of the tool corresponding to said two positions of the slide member the frame member has a recess for receiving an end part of the tool therein when moving the hook member between said positions thereof.

* * * * *